US008225756B2

(12) United States Patent
Schoen et al.

(10) Patent No.: US 8,225,756 B2
(45) Date of Patent: Jul. 24, 2012

(54) ADJUSTING DEVICE FOR VARIABLE VALVE CONTROL

(75) Inventors: Helmut Schoen, Oesterreich (AT); Peter Kuhn, Weinheim (DE); Gordon Koehne, Bregenz (AT); Patric Hoecker, Tosters (AT)

(73) Assignee: ThyssenKrupp Presta TecCenter AG, Eschen (LI)

( * ) Notice: Subject to any disclaimer, the term of this patent is extended or adjusted under 35 U.S.C. 154(b) by 702 days.

(21) Appl. No.: 11/885,227

(22) PCT Filed: Feb. 7, 2006

(86) PCT No.: PCT/EP2006/001073

§ 371 (c)(1), (2), (4) Date: Mar. 31, 2009

(87) PCT Pub. No.: WO2006/094589

PCT Pub. Date: Sep. 14, 2006

(65) Prior Publication Data

US 2009/0194048 A1 Aug. 6, 2009

(30) Foreign Application Priority Data

Mar. 4, 2005 (DE) ..... 10 2005 010 484

(51) Int. Cl.
*F01L 1/34* (2006.01)

(52) U.S. Cl. ..... 123/90.16; 123/90.15; 123/90.39; 123/90.44; 464/160

(58) Field of Classification Search ..... 123/90.39, 123/90.44, 90.15, 90.16, 90.17, 90.18; 464/1, 464/2, 160

See application file for complete search history.

(56) References Cited

U.S. PATENT DOCUMENTS

| | | | |
|---|---|---|---|
| 5,161,493 | A | 11/1992 | Ma |
| 6,135,076 | A | 10/2000 | Martinez |
| 6,907,852 | B2 | 6/2005 | Schleusener et al. |
| 2007/0051329 | A1 | 3/2007 | Schon et al. |

FOREIGN PATENT DOCUMENTS

| | | | |
|---|---|---|---|
| DE | 32 04 841 | A1 | 8/1983 |
| DE | 41 35 257 | A1 | 4/1993 |
| DE | 103 12 961 | B3 | 5/2004 |
| EP | 0 365 338 | A1 | 4/1990 |
| WO | WO 02-092972 | | 11/2002 |

*Primary Examiner* — Ching Chang

(74) *Attorney, Agent, or Firm* — Crowell & Moring LLP

(57) ABSTRACT

Disclosed is an adjusting mechanism for rotating the adjusting shaft of a variable valve control device for combustion engines, in which the crank of a crank-rocker mechanism or slider-crank mechanism is mounted on the camshaft and in which the rocker of the crank-rocker mechanism or the slider of the slider-crank mechanism can entrain the adjusting shaft in the desired direction of rotation by means of switchable freewheels.

17 Claims, 6 Drawing Sheets

ADJUSTING DEVICE FOR VARIABLE VALVE CONTROL

The invention relates to an adjusting device for variable valve drives according to the preamble of claim 1.

In order to improve the operating behaviour of internal combustion engines, in particular of motor vehicles, in terms of performance, consumption and emissions, a relatively large number of variable valve controllers has been developed. In essence, they allow the valve stroke, opening duration and phase position to be adapted to the respective operating states.

The present invention relates to the adjustment of those types of variable valve controllers which are adjusted by rotation of a so-called adjusting shaft. The adjusting shaft typically has cam discs which for their part produce the necessary adjusting movements generally for a row of cylinders. An example of this type of valve controllers having an adjusting shaft and cam disc is described in DE 41 35 257. This document does not describe the drive of the adjusting shaft, since it can be produced in a known manner in accordance with the prior art by means of an electric gear motor. This rotates the adjusting shaft as required and after control by the engine management system either in a first direction of rotation which produces a larger valve stroke, or in a second, opposite direction of rotation which produces a smaller valve stroke.

The adjustment by an electric gear motor has a substantial disadvantage by virtue of the fact that the adjusting power actually required on the cam discs is supplied by the crank shaft by multiple energy conversion with in each case a poor degree of efficiency, so that the power taken from the crank shaft constitutes a multiple of the adjusting power actually required on the cam discs. Under certain circumstances, the corresponding losses considerably diminish the advantages which can be achieved with the variable valve controller.

The total efficiency which is produced from the efficiencies of the generator drive, the generator itself, the electromotor and the gear mechanism which is generally a worm gear by reason of the necessary transmission ratio, can be estimated with the following assumptions of the individual efficiencies.

Belt drive crank shaft-generator: 0.95, generator: 0.60, electromotor 0.70, worm gear 0.75. For the entire chain, multiplication of the individual efficiencies produces an efficiency of 0.3 or 30%, or more than three times the actually required power is taken from the crank shaft.

The object of the invention is to provide an adjusting device for variable valve controllers which comprises a high level of efficiency and in which the power requirement on the crank shaft for the adjustment is substantially lower than in the case of the known adjusting devices which operate with an electric drive.

This object is achieved by means of an adjusting device having the features of claim 1.

In order to obviate the above, substantial losses, an adjusting device is proposed in accordance with the invention which consists substantially of a mechanical gear mechanism which is disposed in the engine and whose drive power is taken in the form of kinetic energy from one of the shafts rotating in the engine and whose output power is transmitted in the form of kinetic energy to the adjusting shaft in the direction of rotation desired in each case. This ensures that no energy conversion losses occur, as is the case in the adjusting devices known from the prior art by reason of the conversion taking place therein from kinetic energy into electrical energy and then from electrical energy into kinetic energy.

The cam shaft of the valve controller is particularly suitable for providing the adjusting power by reason of its spatial proximity to the adjusting shaft. If a particularly high adjusting speed is required, this can also be the crank shaft. In very general terms, each of the shafts which rotate in the engine with the crank shaft in a synchronous or non-synchronous manner can be used for driving the adjusting device in accordance with the invention.

Since this shaft generally always rotates in the same direction of rotation, the same direction of rotation is also always provided at the input into the gear mechanism of the adjusting device in accordance with the invention, whereas at the gear mechanism output both directions of rotation must be provided in order to drive the adjusting shaft either in the said first direction of rotation, with which the valve stroke is increased, or in the second, opposite direction of rotation in order to reduce the valve stroke. A gear mechanism which satisfies this requirement is defined as a reversing gear. It can be structured into a part which produces the two directions of rotation, and into switching part for optionally coupling the shaft to be driven by the gear mechanism, in this case the adjusting shaft. In conjunction with the present invention, the term reversing gear includes in particular the crank-rocker mechanisms and slider cranks described in detail below. Other gear mechanisms which have the above-stated reversing gear functionality are also encompassed by the inventive concept and fall within the scope of protection of the claims.

A preferred embodiment of the inventive adjusting device or of the gear mechanism used is achieved by the following considerations: If a reversing gear of the type most frequently encountered is used, in which two gear wheel sets are provided each with opposite rotational direction transmission which, depending upon the desired direction of rotation of the adjusting shaft, can optionally be connected to said adjusting shaft in a positive-locking manner, i.e. by means of a switch bushing, then two difficulties arise which are very difficult to overcome.

The first difficulty arises by virtue of the fact that the adjusting shaft must be rotated in a very short time about a specific angle, which is to be adhered to precisely, the switching angle, e.g. by 50° in 0.020 s. This means that the adjusting shaft must be driven for precisely this period of time by the reversing gear at a rotational speed of 417 rpm and that any deviation from this on-time by merely 0.010 s would already result in a deviation in the switching angle of 50%, i.e. 25° or 75° which would represent an unfeasible result. The example shows that the on-time of about 1 ms would have to be adhered to precisely which appears to be virtually impossible with a typical switch coupling.

The second difficulty arises by virtue of the fact that upon engagement of the switch coupling, the rotation of the adjusting shaft would have to be set suddenly to the aforementioned rotational speed (which corresponds to 3000 engine revolutions/min) and that at the end of the on-time it would have to be brought jerkily to a standstill. Impact forces of this type which occur abruptly are extremely undesirable.

In order to avoid these difficulties and at the same time achieve a simple solution, it is proposed in a preferred embodiment of the invention to use a crank-rocker mechanism as the reversing gear, whose crank is mounted on the particular shaft, from which the adjusting power is to be taken, i.e. e.g. on the camshaft, and whose rocker is mounted preferably coaxially with respect to the adjusting shaft and can be connected thereto by means of a switchable, positive-locking coupling. The crank-rocker mechanism provides at its rocker both directions of rotation in rapid alternation. It performs an approximately harmonic, oscillating rotational movement, of which the amplitude, e.g. 30°, is sufficient for an adjusting procedure. Since the engagement and disengagement of the switch coupling is performed in the region of the reversal points of the rocker movement, the precision requirements upon the respective switching points in time are mitigated and during engagement and disengagement the adjusting shaft is not influenced or is only slightly influenced by disruptive impact forces.

Depending upon structural characteristics, it can be even more favourable to use a slider crank instead of the crank-rocker mechanism, e.g. if the axle base between the camshaft and the adjusting shaft is small. Moreover, the slider crank has the characteristic that it can apply turning moments of different magnitude in both directions of rotation of the slider, namely a larger turning moment when the crankpin is located at a greater distance from the axis of rotation of the slider and a smaller turning moment in the opposite case.

It is therefore obvious to associate the adjustment to the larger valve stroke with the first-mentioned direction of rotation which requires a substantially larger turning moment on the adjusting shaft, and vice-versa.

As already set forth, the advantage of the crank-rocker mechanism and slider crank over other reversing gears is that the switch coupling is engaged or disengaged in the regions of the reversal points of the rocker and slider movement, where their angular speeds are low. In order to further improve the switching precision, it is also proposed in accordance with the invention to select the double angular amplitude of the rocker or slider to be larger than the adjusting angle of the adjusting shaft and to provide the difference as circumferential backlash, within which the engagement procedure can be implemented with comparatively small demands upon the point in time thereof. Furthermore, the disengagement procedure can thereby be bound precisely to a specific position of the rocker or slider, namely to a reversal point, in that a ratchet freewheel, one for each direction of rotation, is provided as the switch coupling.

The ratchet freewheel can be formed in very different ways. For example, a ratchet which operates on two sides and has a swivel joint can be guided by the rocker or slider and can engage radially into a toothing arrangement which is connected in a rotationally fixed manner to the adjusting shaft. In the case of a further, important exemplified embodiment, several pins which act as ratchets can be guided by prismatic joints in an axially displaceable manner in a drum, which is connected in a rotationally fixed manner to the adjusting shaft, and said pins engage into corresponding recesses in the hub region of the rocker or slider. An adjusting procedure is then performed as follows: In the region of the circumferential backlash and a first reversal point of the rocker or slider, the ratchet of the freewheel is moved to the locked position, which can occur by means of an electromagnet which is activated by the engine management system. After this first reversal point, the rocker or slider moves at increasing angular speed entraining the ratchet in the direction of the second reversal point until the circumferential backlash is exhausted, the ratchet bears the load and the adjusting shaft is entrained. Finally, upon reaching the second reversal point, the freewheel releases the connection between the rocker and the slider and the adjusting shaft and the ratchet returns to its starting position. Therefore, the adjusting angle is only dependent upon the manufacturing precision of the components involved. The greater the aforementioned circumferential backlash is selected to be, i.e. the more the double angular amplitude of the rocker or slider exceeds the adjusting angle of the adjusting shaft, the more time is available to move the ratchet to the locked position, but naturally also the greater will be the impact when the play is exhausted. Play of 2 to 10% of the adjusting angle proves to be a favourable compromise.

The adjusting shaft not only has to be rotated in a reciprocating manner by the adjusting angle between two positions, it must also be possible to adjust the adjusting shaft several times consecutively by the same adjusting angle in a continuous manner in the same direction of rotation. In this manner, the valve stroke is increased or reduced in steps. The entire adjusting range from zero stroke to maximum stroke can be covered e.g. by seven angular positions of the adjusting shaft or steps, between which on six occasions there is provided the adjusting angle of e.g. 50°. The entire torsional range of the adjusting shaft would then be 300°. Since the adjusting shaft can only be adjusted by the extent of the adjusting angle with each revolution of the shaft which drives the adjusting device, a small number of steps has the advantage of a rapid adjustment over the entire range and the advantage of a small number of switching procedures during practical operation, with correspondingly low average adjusting power. However, a greater number of steps has the advantage of a more precise adaptation of the valve stroke to suit the operating conditions, smaller adjusting angles and smaller impacts upon engagement of the ratchet. It has been shown in practice that an overall favourable compromise is achieved with five to seven positions of the adjusting shaft, or steps, wherein the first position can be allocated to the zero stroke of the valves and the highest step, i.e. the fifth, sixth or seventh can be allocated to the maximum stroke.

If all of the cam discs mounted on an adjusting shaft were designed in an identical manner, then the first position according to the statement above would cause all of the cylinders to be shut off. However, this is not practical in most cases, and e.g. in the case of the most frequent engine design having four cylinders in series and an adjusting shaft for e.g. all inlet valves. In this case, only two cylinders are allowed to be shut off, while the two other cylinders must continue to deliver power. For this reason, in the event of cylinder shut-off the cam discs of an adjusting shaft must be designed generally differently, e.g. such that in the case of the cylinders which are not shut off, the valve stroke of a higher position approximately already occurs in the first position. The valve stroke which is set for a valve is not merely dependent upon the angular position of the adjusting shaft but also upon the cam disc which is operatively allocated to this valve.

If the rotation of the cam discs then leads to a continuous change in the valve stroke, then the forces which are to be absorbed by the cam discs result in moments which attempt to change the angular position of the cam discs, or result in deviations in the valve stroke. Moreover, the angular positions of the cam discs are subjected to certain tolerances anyway. For these reasons, it is proposed in accordance with the invention to form the cam discs in such a manner that the derivation of the valve stroke according to the angle of rotation of the cam disc becomes zero in the region of the engagement points of the switched positions. In other words, in the region of the engagement points of the switched positions, the cam discs are designed as concentric circular arcs over a periphery of at least 3°.

The invention will now be explained in detail with reference to a drawing, in which FIG. 1 shows a sectional view perpendicular to the axis of a variable valve controller which is adjusted by rotation of an adjusting shaft, wherein a zero stroke of the valve is set.

Figure 1:
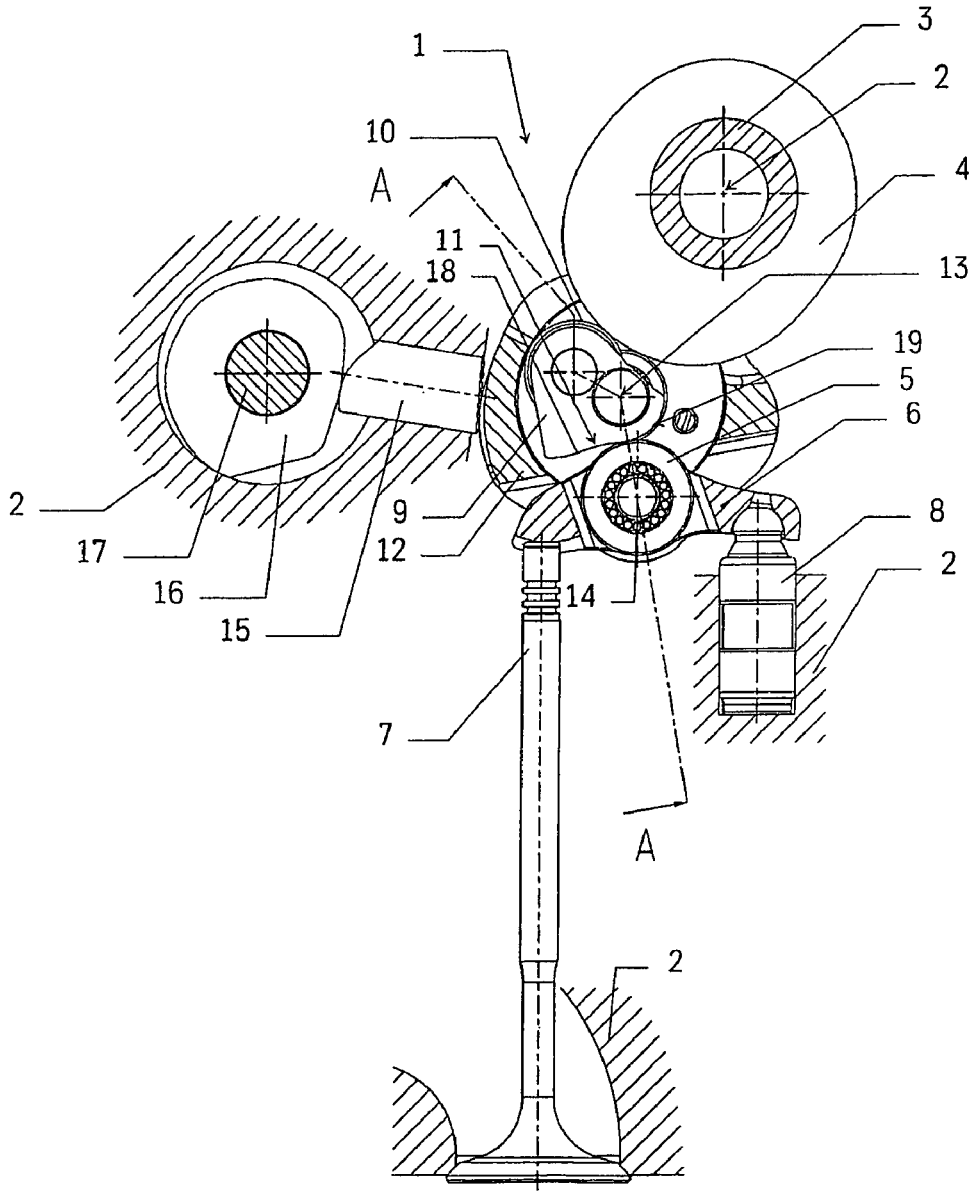

FIG. 1 shows a variable valve controller which is typical for adjustment by rotation of an adjusting shaft. The valve controller 1 is driven by a camshaft 3 which is mounted in the housing 2 and on which cams 4 are located. In the case of conventional, non-variable valve controllers the cam 4 is in direct engagement with the roller 5 which is located in the cam follower 6 which for its part actuates the valve 7 and is supported in the housing 2 via the hydraulic valve clearance equalisation element 8. In contrast thereto, in the case of the variable valve controller 1, a further gear mechanism member, a so-called intermediate member 9 is switched into the force flow between the cam 4 and the cam follower roller 5. On the one hand, the said intermediate member is in engagement with the cam 4 via a cam roller 10 or even via a sliding contact and on the other hand is in engagement with the cam follower roller 5 via a radial cam 11. Furthermore, the intermediate member 9 is mounted in an intermediate housing 12 in such a manner as to be able to rotate about the axis 13. The intermediate housing 12 is mounted in the housing 2 in such a manner as to be able to rotate about the axis 14 and is moved to a specific angular position by the tappet 15 which is guided in the housing 2. For its part, the tappet 15 is actuated by a cam disc 16 which is located on the adjusting shaft 17 which is mounted in the housing 2. This produces a rotation of the adjusting shaft 17, a small rotation of the intermediate housing 12 about its axis of rotation 14. In the Figure, the intermediate housing 12 is rotated by the corresponding position of the adjusting shaft 17 or the cam disc 16 and the tappet 15 to the end position which is on the left-hand side in the illustration. In this position, no valve stroke is produced even if the cam tip is in engagement because the control portion 18 of the radial cam 11 does not come into engagement with the cam follower roller 5, but only the latching port 19. The axis of the cam follower roller 5 coincides with the axis of rotation 14 of the intermediate housing 12.

Figure 2:
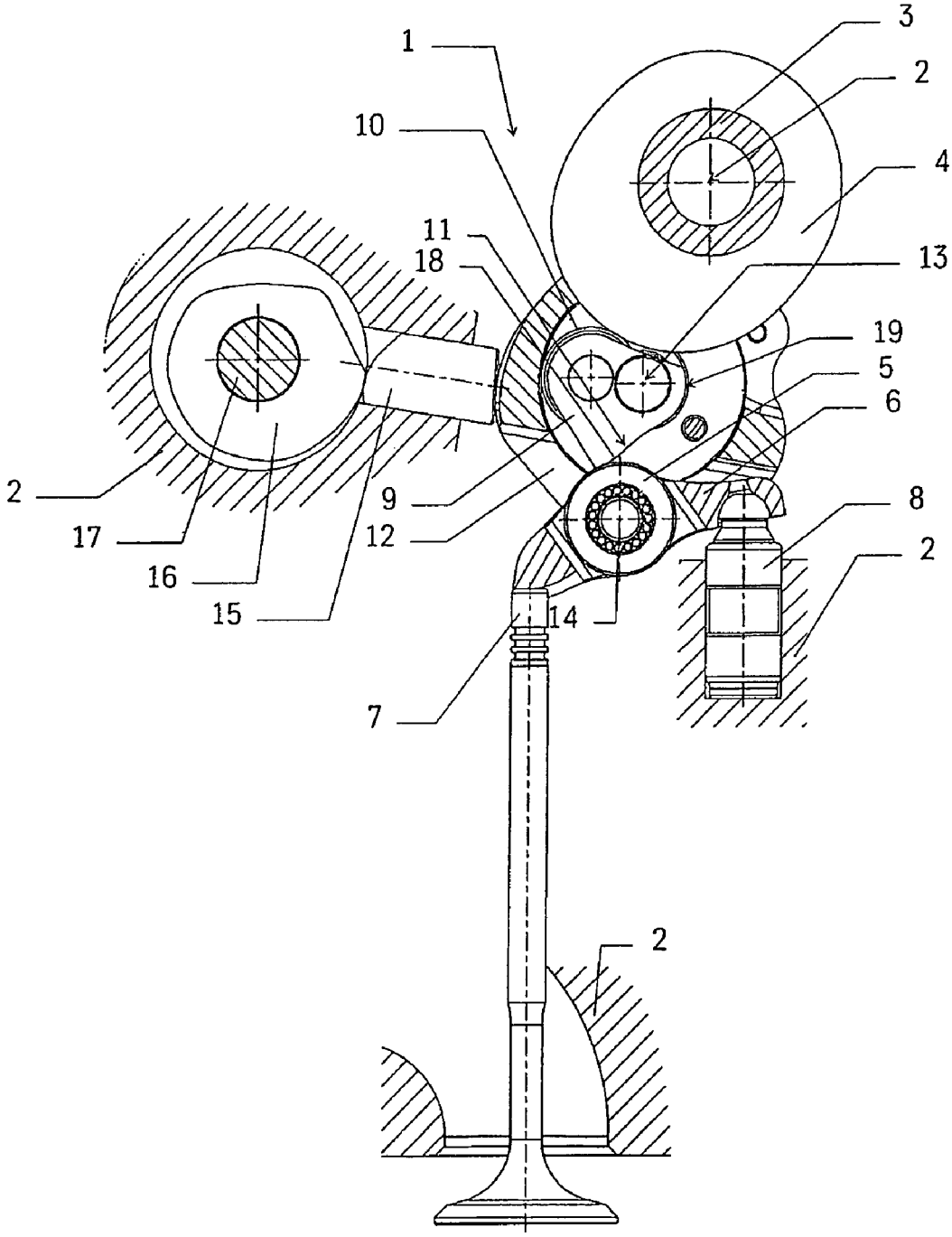
FIG. 2 shows a sectional view perpendicular to the axis of the valve controller of FIG. 1, wherein the maximum stroke of the valve is set.

FIG. 2 illustrates the valve controller of FIG. 1 after rotation of the adjusting shaft 17 through approximately 270° in a clockwise direction which results in a rotation of the intermediate housing 12 through approximately 20° in a clockwise direction, so that the complete valve stroke is achieved when the cam tip is in engagement. The cam follower roller 5 reaches its highest point on the control portion 18 of the radial cam 11. Therefore, in the embodiment illustrated in the Figure, an angle of rotation of the adjusting shaft 17 through 270° is associated with a change in the valve stroke from zero to the maximum value.

Figure 3:
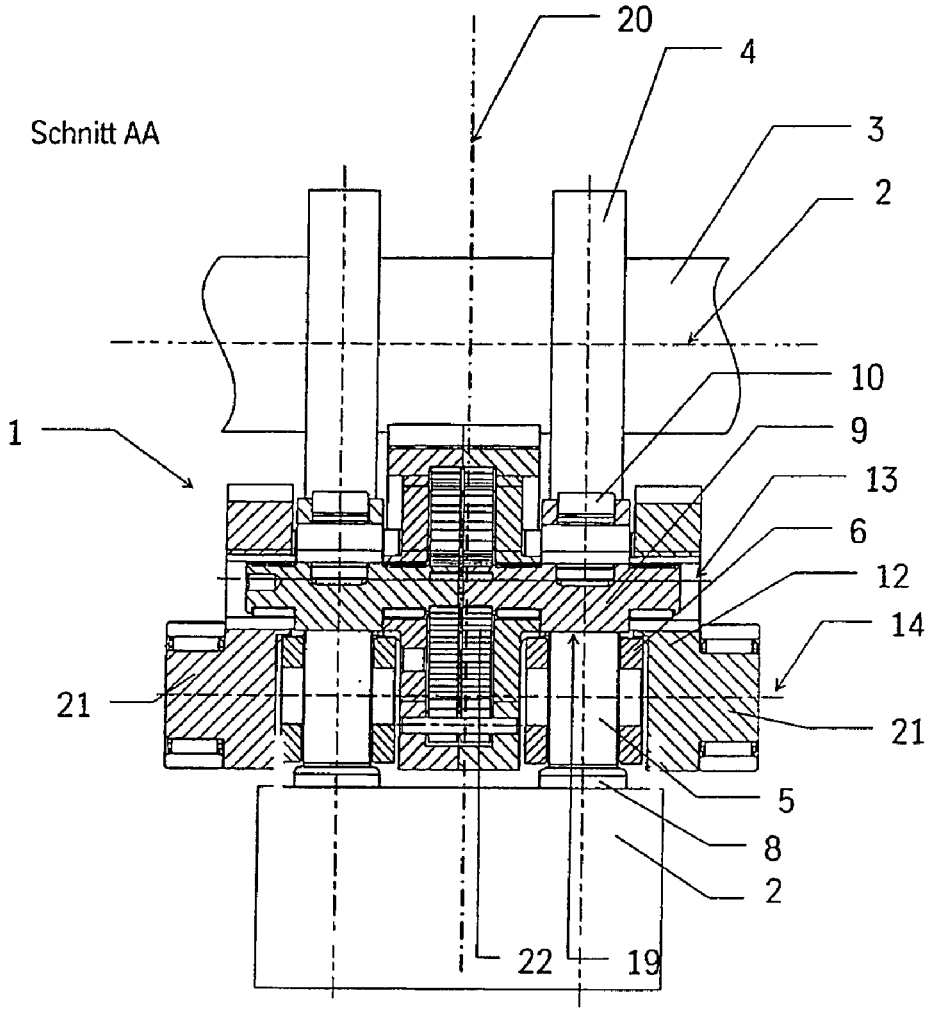
FIG. 3 shows a longitudinal sectional view of parts of the valve controller taken along A-A in FIG. 1.

FIG. 3 illustrates a sectional view according to A-A in FIG. 1 which shows that for two parallel valves in each case a respective inlet or outlet of a cylinder, a common intermediate housing 12, can be used, so that only one tappet and cam disc are required. The intermediate housing 12 has a plane of symmetry 20, in which the tappet, not illustrated, can also be located, and is mounted with the pin 21 on both sides in the housing 2 in such a manner as to be able to rotate about the axis 14. Mounted in the intermediate housing 12 are the intermediate members 9 which support the cam rollers 10 and the latching portions 19 of the radial cams are in contact with the cam follower rollers 5 by reason of the restoring forces of the hydraulic valve clearance equalisation elements. For each intermediate member 9, the intermediate housing 12 also contains a helical spring 22 which maintains the contact between the cam 4 and the cam roller 10 in each phase of the movement. For the sake of improved clarity, the reference numerals in FIG. 3 are provided only for the components on the right-hand side of the illustration.

Figure 4:
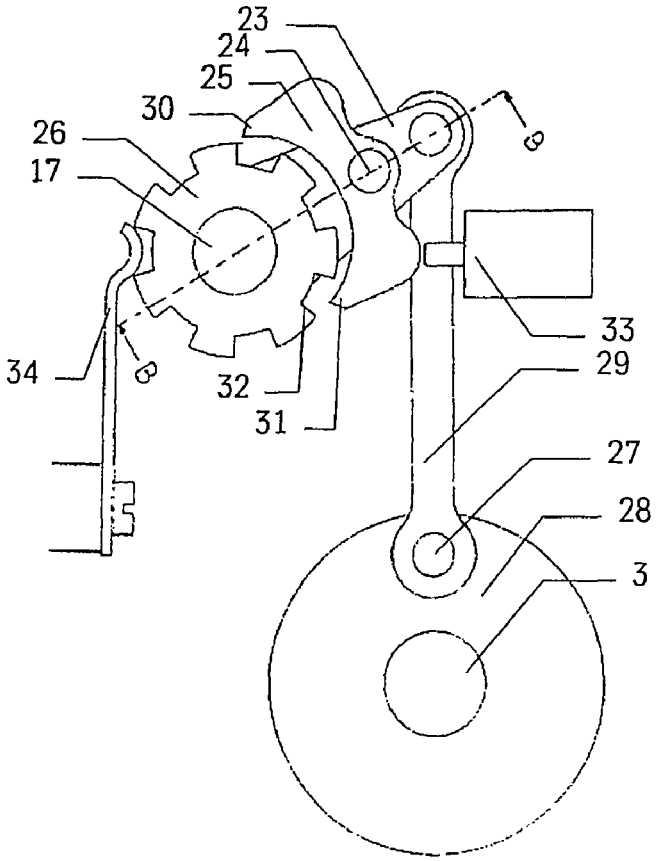
FIG. 4 shows a view perpendicular to the axis of an adjusting device in accordance with the invention using a crank-rocker mechanism and a ratchet which operates on two sides and is guided by the rocker with a swivel joint. An end position of the rocker is illustrated.

FIG. 4 illustrates an adjusting device in accordance with the invention using a crank-rocker mechanism and a ratchet 25 which operates on two sides and is guided by the rocker 23 with a swivel joint 24. The toothing arrangement which cooperates with the ratchet 25 is mounted on a disc 26 which for its part is pressed on to the end-side end of the adjusting shaft 17. The crank consisting of a crankpin 27 and a crank web 28 is attached to the end-side end of the camshaft 3 and causes the rocker 23, which is rotatably mounted on the adjusting shaft 17, to perform an oscillating rotational movement via the connecting rod 29. The position illustrated is the end position of the rocker 23 which may have been reached at the end of an entrainment of the adjusting shaft 17 in an anticlockwise direction by the value of the adjusting angle, after the tooth 30 of the ratchet 25 has been released from the toothed lock washer 26. However, the position can also be the same at the beginning of a rotation of the adjusting shaft 17 in a clockwise direction, which actually commences when the electromagnet 33 is activated, the circumferential backlash is exhausted and the tooth 31 of the ratchet 25 impinges upon the tooth flank 32. The circumferential backlash is produced from the difference between the double amplitude of the rotational movement of the rocker and the adjusting angle and affords the electromagnet 33 time to move the ratchet 25 to the locked position.

A leaf spring 34 engages into the toothed lock washer 26 and locks the adjusting shaft 17 in the respectively set position.

Figure 5:
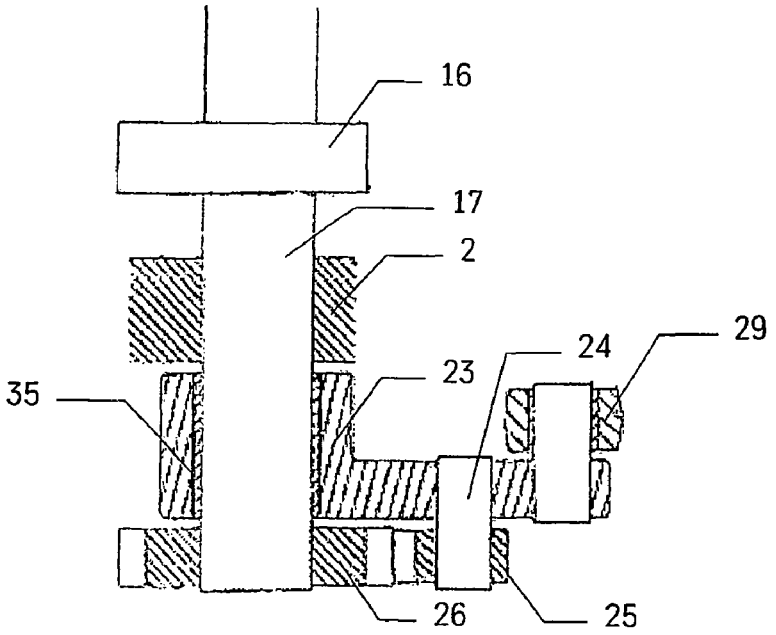
FIG. 5 shows the adjusting device of FIG. 4 in a longitudinal sectional view taken along B-B in FIG. 4.

FIG. 5 shows the adjusting device of FIG. 4 in a longitudinal sectional view B-B. The adjusting shaft 17 is mounted in the housing 2. Connected thereto in a rotationally fixed manner are the toothed lock washer 26 and the cam discs 16 so that a rotation of the toothed lock washer 26 about the adjusting angle also produces a rotation of the cam discs about the same angle. For the rocker 23, the adjusting shaft 17 forms the spindle on which it is supported via a bearing 35.

Figure 6:
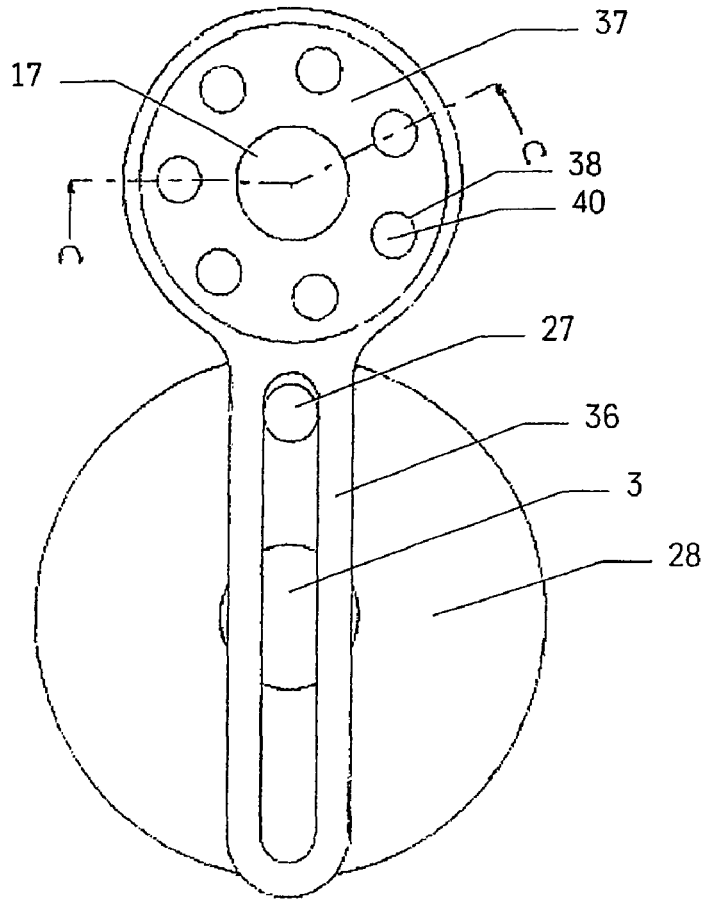
FIG. 6 shows the view perpendicular to the axis of an adjusting device ink accordance with the invention using a slider crank and for each angular position a ratchet which is guided with a respective swivel joint in the adjusting shaft.

FIG. 6 illustrates the adjusting device in accordance with the invention using a slider crank in the view perpendicular to the axis. In contrast to the embodiment having a crank-rocker mechanism as shown in FIG. 4, the pin 27 of the crank engages into a slider 36 which, like the rocker, is mounted in a rotatable or pivotable manner on the adjusting shaft 17. Furthermore, in contrast to the embodiment as shown in FIGS. 4 and 5, a perforated drum 37 instead of the toothed lock washer is pressed on to the end-side end of the adjusting shaft 17. Each of the axially parallel bores 38 of the perforated drum 37 contains and guides a cylinder pin 40, of which in each case one can be moved into engagement in the hub region of the slider likewise with the aid of an electromagnet, optionally with one of two cut-outs, each one for a direction of rotation. As shown in detail in FIG. 8, these cut-outs 41 and 42 are formed in such a manner that the engaging cylinder pin 40 can transmit a turning moment to the slider only in one direction, but is pushed back to its starting position when the direction of rotation is reversed. For this purpose, the base of the cut-outs 41, 42 is contoured accordingly.

The cylinder pin 40 thus also constitutes a ratchet which is guided in a prismatic joint. The position illustrated is one in which a rotation of the camshaft in the clockwise direction produces the highest angular speed of the slider in the anticlockwise direction which is, however, associated with the smallest turning moment on the slider. Therefore, it is suitable for switching to a smaller valve stroke. In the example, a perforated drum 37 is illustrated having seven cylinder pins or ratchets, in each case at intervals of 360°/7=51.429° for seven positions of the adjusting shaft 17. The illustrated angular amplitude of the slider is 28°, so that the double angular amplitude is greater than the adjusting angle by the factor of 2×28/51.429=1.09. The circumferential backlash is 4.571°.

It is understood that the perforated drum 37 as described above in relation to the slider 36 can also cooperate with the rocker 23 in a completely similar manner to how it has been described with respect to the exemplified embodiments as shown in FIGS. 4 and 5. For this purpose, the rocker 23 must only be formed in its hub region in the manner described above in relation to the hub region of the slider 36.

At this juncture, it should be noted that the switching device which is described above in relation to the rocker 23 and comprises a toothed lock washer 26 and a ratchet 25, which cooperates with the toothing arrangement of this toothed lock washer 26, can naturally also cooperate with the slider 36. The reversing gears described (crank-rocker mechanism and slider crank) and the switching devices described (toothed lock washer 26 with ratchet 25 and perforated drum 37 with cylinder pins 40) can be combined in any way within the scope of the present invention.

Figure 7:
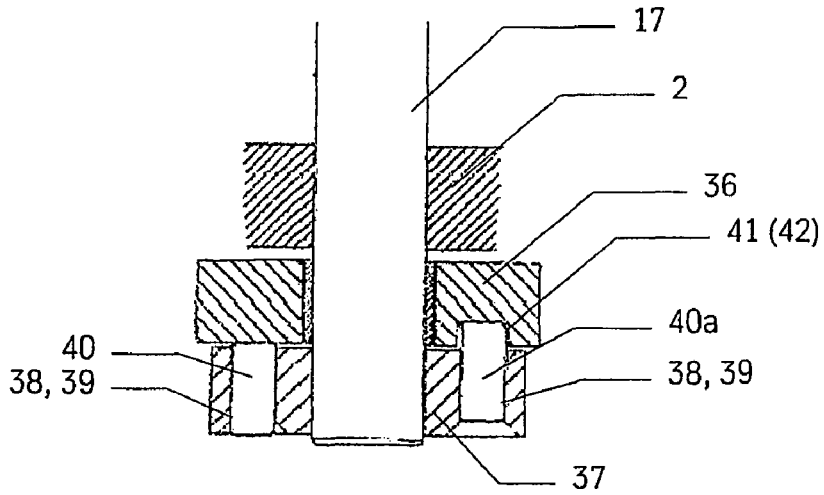
FIG. 7 shows the adjusting device of FIG. 6 in a sectional view taken along C-C in FIG. 6.

FIG. 7 illustrates a longitudinal sectional view of the adjusting device as shown in FIG. 6 taken along the section C-C. It shows the adjusting shaft 17 which is mounted in the housing 2, the slider 36 mounted thereon and the pressed-on perforated drum 37. In one of the illustrated bores 38 of the perforated drum 37 a cylinder pin 40 is located in the starting position. In another bore 38 the cylinder pin 40*a* is located in the switched position. The cylinder pins 40 which operate as ratchets are thus guided in the perforated drum 37 by prismatic joints which are formed by the peripheral surfaces 39 of the cylinder pins 40 and the walls of the bores 38. The cylinder pin 40 which is to be switched in each case is moved to the switched position by means of an electromagnet, not illustrated. Depending upon the desired adjusting position, to a larger or smaller valve stroke, this must occur in the region of the one or other end position.

Figure 8:
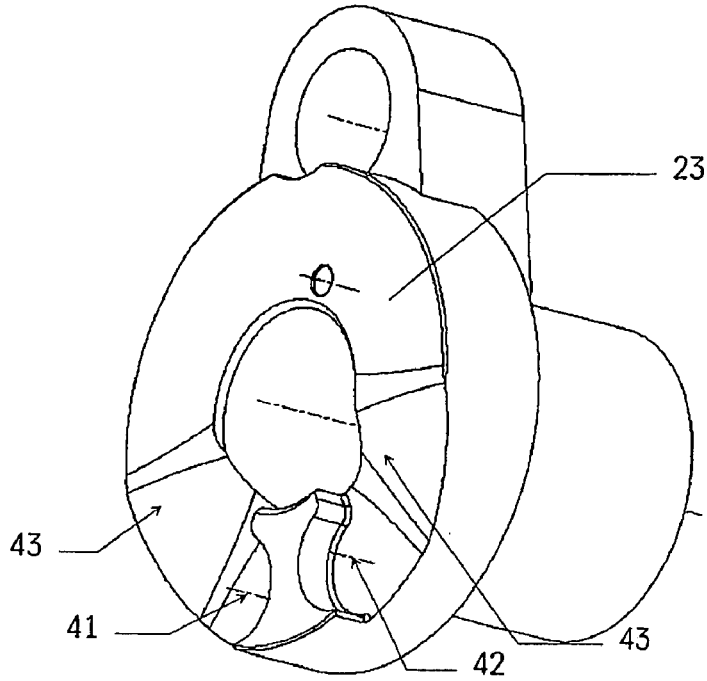
FIG. 8 shows the perspective view of an embodiment of the rocker in the hub region.

FIG. 8 illustrates a perspective view of a rocker 23 which is formed for the purpose of cooperating with a perforated drum, not illustrated, in a similar manner to FIGS. 6 and 7. The rocker 23 comprises in the region of the hub the cut-out 41 for the entrainment of a cylinder pin with the perforated drum and adjusting shaft in a clockwise direction and comprises the cut-out 42 for the rotation in an anticlockwise direction. In the case of the respectively opposite rotation of the rocker 23 during the return movement, the previously switched cylinder pin, not illustrated, operating as a ratchet is pushed back along one of the ramps 43 to its starting position, so that a freewheel of the perforated drum, not illustrated, is produced.

Figure 9:
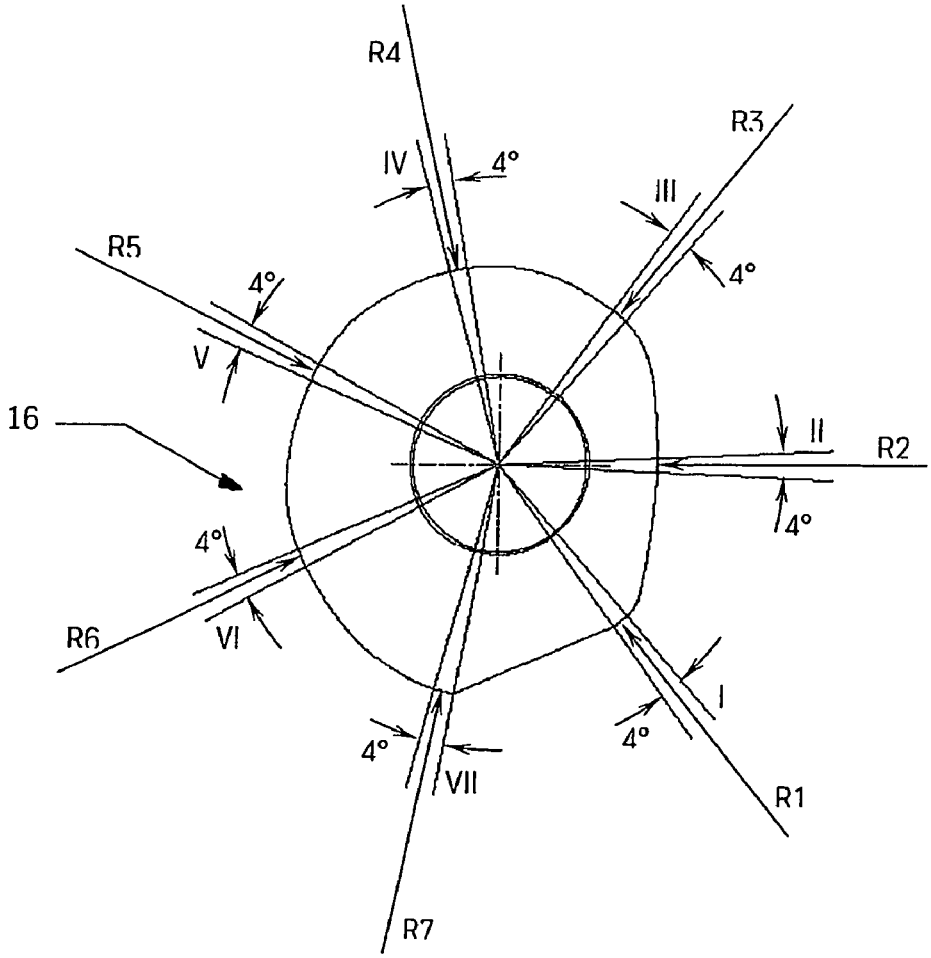
FIG. 9 shows the view of a cam disc.

FIG. 9 illustrates a cam disc 16 which is formed in the region of the switched positions I-VII by circular arc portions R1 to R7 which are concentric with respect to the axis of the adjusting shaft and which extend in each case over an angle of 4°.

LIST OF REFERENCE NUMERALS 1 valve controller
2 housing
3 camshaft
4 cam
5 cam follower roller
6 cam follower
7 valve
8 hydraulic valve equalisation element
9 intermediate member
10 cam roller
11 radial cam
12 intermediate housing
13 axis of rotation of the intermediate member
14 axis of rotation of the intermediate member
15 tappet
16 cam disc
17 adjusting shaft
18 control portion
19 latching portion
20 plane of symmetry
21 pin (intermediate housing)
22 helical spring
23 rocker
24 swivel joint for ratchet
25 ratchet
26 toothed lock washer for ratchet
27 crankpin
28 crank web
29 connecting rod
30 left tooth of the ratchet
31 right tooth of the ratchet
32 tooth flank
33 electromagnet
34 leaf spring
35 rocker bearing
36 slider
37 perforated drum
38 bores (in the perforated drum)
39 peripheral surface of the cylinder pins
40 cylinder pins
40*a* switched cylinder pin
41 cut-out
42 cut-out
43 ramps

The invention claimed is:

1. An adjusting device for variable valve controllers of internal combustion engines, comprising a rotatably mounted adjusting shaft for adjusting the valve movement, and actuating means which act upon the rotatably mounted adjusting shaft and effect an adjusting rotation thereof, wherein the actuating means at least comprise:

a) a mechanical reversing gear which derives the adjusting power required for the adjusting rotation from the crankshaft of the engine or another rotating shaft, whose rotation is derived from the crankshaft, b) switchable coupling means for transmitting the adjusting power from the reversing gear to the rotatably mounted adjusting shaft wherein the reversing gear comprises a crank-rocker mechanism, whose crank is mounted on a camshaft, which rotates in the engine and from which the adjusting power is taken, and whose rocker is mounted coaxially with respect to the rotatably mounted adjusting shaft and is connectable thereto directly or indirectly by means of a switch coupling, or a slider crank, whose crank is mounted on the camshaft, which rotates in the engine and from which the adjusting power is taken, and whose slider is mounted coaxially with respect to the rotatably mounted adjusting shaft and can be connected thereto directly or indirectly by means of a switch coupling.

2. The adjusting device as claimed in claim 1, wherein the switchable coupling means are integrated into the mechanical reversing gear or are coupled directly thereto.

3. The adjusting device as claimed in claim 1, wherein the extraction of the adjusting power from the camshaft.

4. The adjusting device as claimed in claim 1, wherein a double angular amplitude of the rocker or slider is greater than that adjusting angle of the rotatably mounted adjusting shaft.

5. The adjusting device as claimed in claim 4, wherein the double angular amplitude of the rocker or slider which is 2 to 10% greater than the adjusting angle of the rotatably mounted adjusting shaft.

6. The adjusting device as claimed in claim 1, wherein the switch coupling between the rocker or slider and the rotatably mounted adjusting shaft is formed by a switchable ratchet freewheel which operates on two sides.

7. The adjusting device as claimed in claim 6, wherein two separate ratchets are provided for the two directions of rotation.

8. The adjusting device as claimed in claim 6, wherein a common, dual-acting ratchet is provided for both directions of rotation.

9. The adjusting device as claimed in claim 6, wherein in each case a separate, ratchet, which is formed by a cylinder pin, for each switching position of the rotatably mounted adjusting shaft.

10. The adjusting device as claimed in claim 6, wherein the ratchet or the ratchets is/are mounted on the rocker or slider and an associated toothing arrangement is provided on the rotatably mounted adjusting shaft or on a component which is connected thereto in a rotationally fixed manner.

11. The adjusting device as claimed in claim 6, wherein the ratchet or the ratchets is/are mounted on the rotatably mounted adjusting shaft or on a component which is connected thereto in a rotationally fixed manner and an associated toothing arrangement is provided in the form of cut-outs on the rocker or slider.

12. The adjusting device as claimed in claim 6, wherein swivel joints for guiding the ratchets.

13. The adjusting device as claimed in claim 6, wherein prismatic joints for guiding the ratchets which are formed as cylinder pins.

14. The adjusting device as claimed in claim 1, wherein an electric lifting magnet, which is controllable by the engine management system, for activating the ratchet to be switched in each case.

15. The adjusting device as claimed in claim 1, wherein five to seven switchable angular positions of the rotatably mounted adjusting shaft which are each disposed at a spaced interval with respect to each other and cover the entire valve stroke spectrum from the zero stroke of the valve to the complete stroke.

16. The adjusting device as claimed in claim 1, wherein differently formed cam discs are mounted on the rotatably mounted adjusting shaft and, during a single adjusting rotation of the rotatably mounted adjusting shaft, produce different valve control movements of the valves associated therewith.

17. The adjusting device as claimed in claim 1, wherein cam discs which in the region of the engagement points of switched positions are formed as circular arcs which are concentric with respect to the rotatably mounted adjusting shaft.

* * * * *